US005691251A

United States Patent [19]

Skopic

[11] Patent Number: 5,691,251

[45] Date of Patent: Nov. 25, 1997

[54] CONNECTOR KIT, AND CONNECTOR ASSEMBLY

[75] Inventor: Albert D. Skopic, York, Pa.

[73] Assignee: Osram Sylvania Inc., Danvers, Mass.

[21] Appl. No.: 615,666

[22] Filed: Mar. 13, 1996

[51] Int. Cl.[6] ..... H01R 13/00

[52] U.S. Cl. ..... 439/578; 439/675

[58] Field of Search ..... 439/578–585, 439/675, 668, 669, 751, 745, 677, 746, 747

[56] References Cited

U.S. PATENT DOCUMENTS

| | | | |
|---|---|---|---|
| 4,129,352 | 12/1978 | Iizuka | 439/675 |
| 4,859,197 | 8/1989 | Toramoto et al. | 439/675 |
| 5,312,271 | 5/1994 | Matsumoto et al. | 439/578 |
| 5,489,222 | 2/1996 | Moyer et al. | 439/578 |
| 5,536,184 | 7/1996 | Wright et al. | 439/578 |

*Primary Examiner*—J. J. Swann
*Attorney, Agent, or Firm*—William H. McNeill

[57] ABSTRACT

A connector is provided including a plastic bushing having a bore which extends therethrough. A contact having an abutment region extends into one end of the bore to an adjacent abutment region of the bushing. A central conductor of a coaxial cable extends into an opposite end of the bore and is soldered to the abutment region of the contact. The plastic bushing is inserted into a conductive connector shell which engages a shield layer of the coaxial cable. The adjacent abutment regions prevent rotation of the contact about its axis.

14 Claims, 6 Drawing Sheets

CONNECTOR KIT, AND CONNECTOR ASSEMBLY

TECHNICAL FIELD

The present invention relates to a connector kit, a connector assembly and a method of securing a connector to an end of a coaxial cable. The present invention is particularly useful in connection with an antenna connector.

BACKGROUND ART

A typical antenna connector for an antenna cable such as those used in the automobile industry for radios includes a male connector body generally comprising a contact in the form of a plug and a female connector body generally comprising a contact in the form of a ferrule which forms a socket. Typically, such contact is inserted into an insulative plastic bushing which is inserted into a conductive connector shell. In use, the male connector body is plugged into the female connector body to effect a mechanical and electrical connection between the two. Typically, an antenna cable in the form of a coaxial cable is electrically and mechanically attached to one of the contacts such as the male or female contact, and the other contact is electrically and mechanically attached to a circuit such as a circuit on a printed circuit board. In such prior art devices inadvertent axial and/or rotational movement of the male or female contact relative to the insulative plastic bushing into which the contact has been inserted makes maintaining a satisfactory electrical connection between the contact and conductor difficult. Even in those instances where the contact is soldered to the conductor, such axial and/or rotational movement may cause the mechanical and electrical connection therebetween to deteriorate to the point of being inoperative.

DISCLOSURE OF INVENTION

It is an object of the present invention to provide a connector wherein a contact does not inadvertently move in a rotational and/or an axial direction relative to an insulative bushing into which the contact extends.

It is another object of the present invention to provide a connector which improves the stability of the electrical and mechanical connection between the contact of the connector and the conductor to which the contact is connected.

A further object of the present invention is to provide a connector which allows for effecting an improved connector assembly.

Yet a further object of the present invention is to provide a relatively simple connector, the components of which may be in kit form.

Another object of the present invention is to provide an improved method of assembling a connector assembly.

These objects are accomplished, in one aspect of the invention, by providing a connector kit, a connector assembly and a method of securing a connector to an end of a coaxial cable. The parts of the kit may comprise an insulative bushing, a conductive contact and a conductive connector shell. The method involves the manner in which these parts may be assembled to provide a connector assembly. Such connector assembly comprises an insulative bushing which extends in a longitudinal direction relative to a longitudinal axis of the insulative bushing from a first bushing end to a second bushing end. The insulative bushing comprises a bore extending in such longitudinal direction from the first bushing end to the second bushing end. The bore comprises a bore surface, the bore surface comprising at least one first abutment region. A contact extends into the bore from the first bushing end towards the second bushing end. The contact comprises at least one second abutment region positioned at an outer surface of the contact. At least one second abutment region is positioned adjacent a first abutment region to prevent turning of the contact around a longitudinal axis of the contact. A coaxial cable is provided which has a length of central conductor extending from an end thereof. The length of central conductor extends into the bore from the second bushing end towards the first bushing end and is electrically and mechanically connected to the contact. A conductive connector shell extends in the longitudinal direction, the insulative bushing extending into the conductive connector shell.

BEST MODE FOR CARRYING OUT THE INVENTION

For a better understanding of the present invention, together with other and further objects, advantages and capabilities thereof, reference is made to the following disclosure and appended claims taken in conjunction with the above-described drawings.

Figure 1:
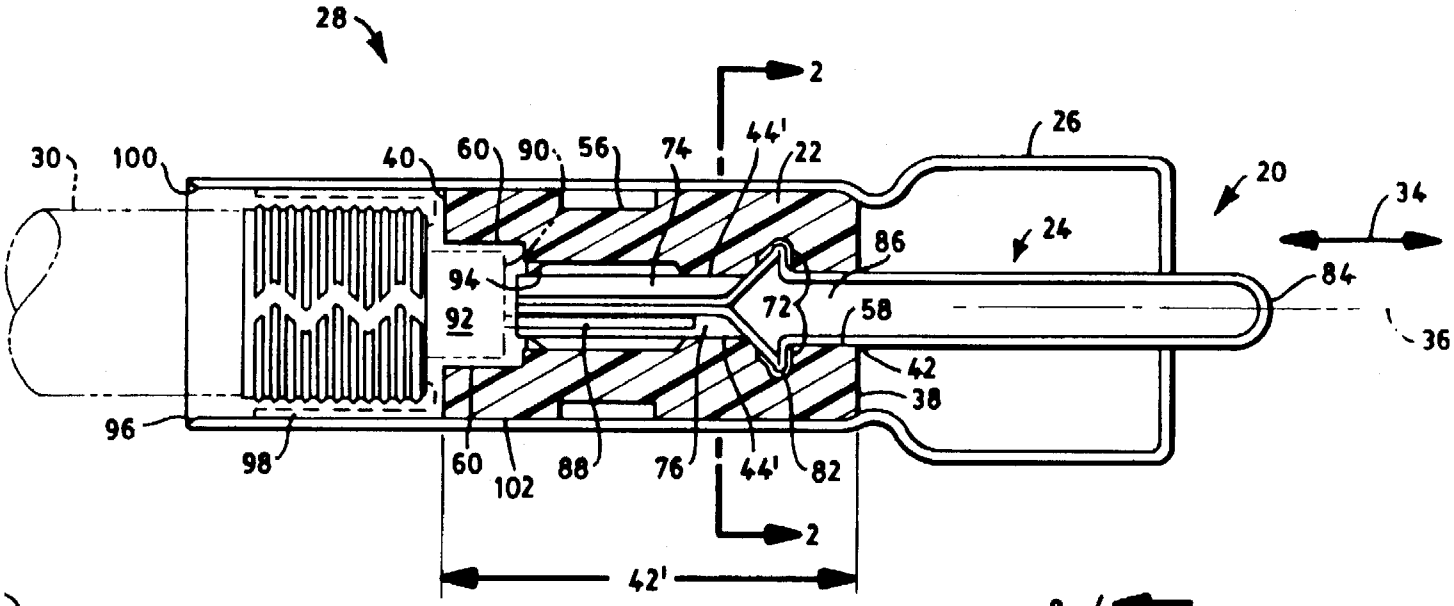
FIG. 1 is a view of kit parts of one embodiment of the present invention assembled with a coaxial cable to provide a connector assembly forming one embodiment of the present invention.
Figure 2:
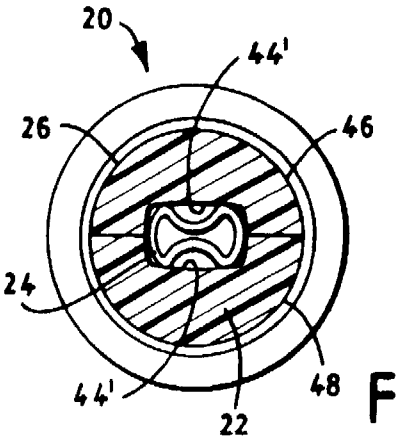
FIG. 2 is a view of FIG. 1 taken along lines 2—2.
Figure 4:
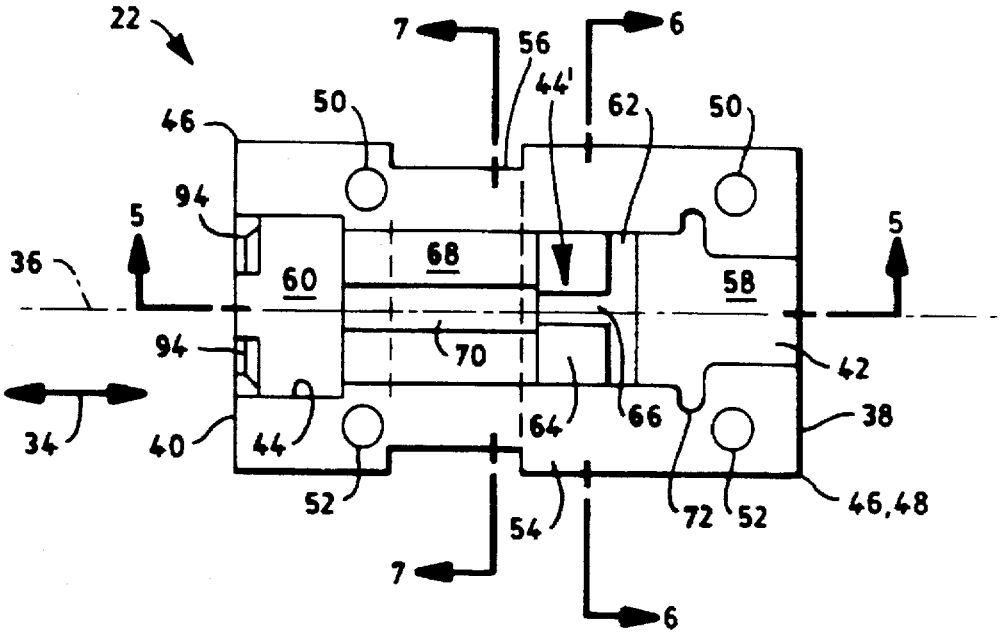
FIG. 4 is a view of a bushing half of the insulative bushing depicted in FIG. 3 taken along lines 4—4 of FIG. 3.
Figure 5:
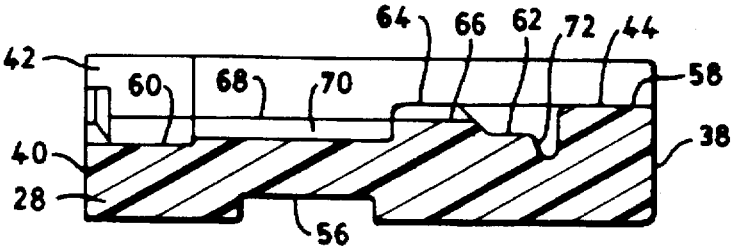
FIG. 5 is a view of FIG. 4 taken along lines 5—5.
Figure 6:
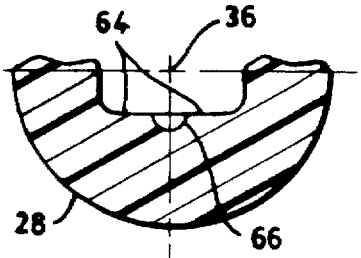
FIG. 6 is a view of FIG. 4 taken along lines 6—6.
Figure 7:
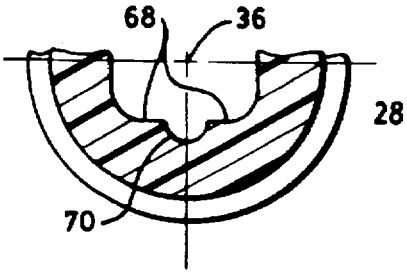
FIG. 7 is a view of FIG. 4 taken along lines 7—7.
Figure 8:
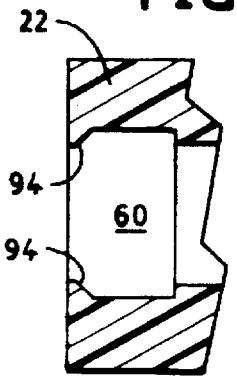
FIG. 8 is a view of FIG. 3 taken along lines 8—8.
Figure 10:
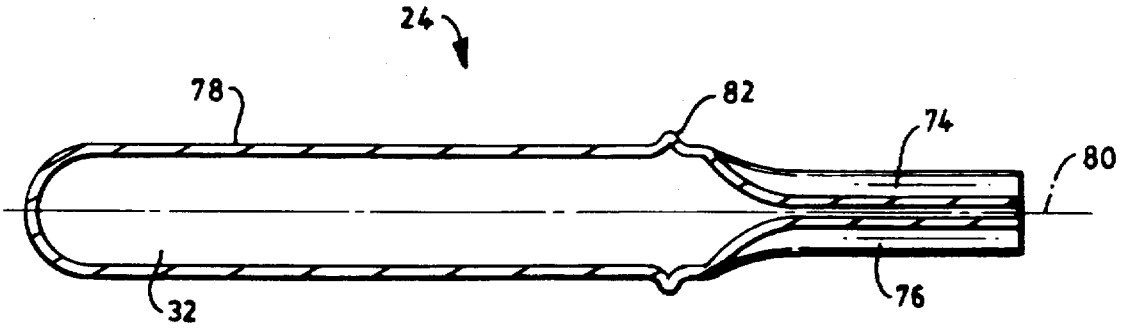
FIG. 10 is a view of FIG. 9 taken along lines 10—10.
Figure 9:
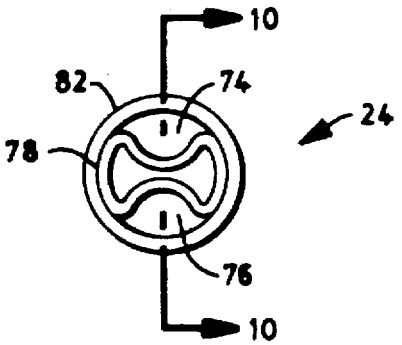
FIG. 9 is an end view of the contact depicted in the embodiment of FIG. 1.

The embodiment of this invention which is illustrated in FIGS. 1 to 10 is particularly suited for achieving the objects of this invention. FIGS. 1 and 2 depict a connector 20 comprising an insulative bushing such as, for example, a plastic bushing 22, a contact 24 and a conductive connector shell 26. Such elements are assembled as depicted in FIG. 1 to provide a connector assembly 28 comprising connector 20 and a coaxial cable 30. In the embodiment of FIGS. 1 and 2, contact 24 is in the form of a male contact having a conventional male prong 32. It will be readily apparent to those having ordinary skill in the art, however, that other types of contacts may be used in connectors which embody the present invention.

FIGS. 3 to 8 depict details of the insulative bushing 22 of FIGS. 1 and 2. Insulative bushing 22 extends in a longitudinal direction 34 relative to a longitudinal axis 36 of the insulative bushing from an end 38 to an opposite end 40. The insulative bushing 22 comprises a bore 42, having a bore length 42', which extends in the longitudinal direction 34 from end 38 to end 40. The bore includes a bore surface 44 which comprises at least one abutment region. In the embodiment of FIGS. 1 to 8, two opposing abutment regions 44' are provided as best seen in FIGS. 1 and 2.

Figure 3:
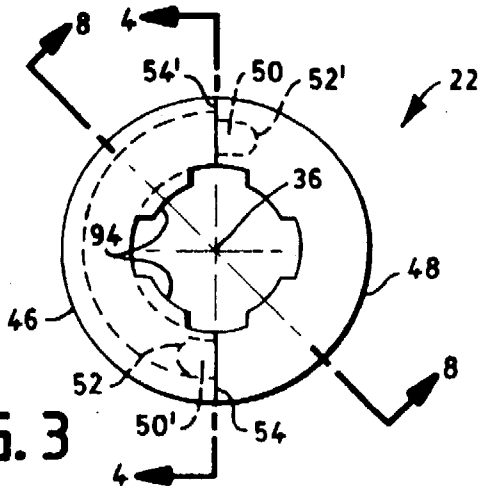
FIG. 3 is an end view of the insulative bushing depicted in the embodiment of FIG. 1.

In the preferred embodiment, the insulative bushing comprises two separable mating halves which may or may not be identical. For example, in the embodiment of FIGS. 1 to 8, the insulative bushing 22 comprises two halves 46, 48 which are identical. Halves 46, 48 are joined together by providing a plurality of protuberances 50 and apertures 52 which extend from and into, respectively, a base surface 54 of each bushing half. Since the halves 46, 48 are identical, they may be joined by mating the protuberances 50 and apertures 52 of one half 46 with similar protuberances 50' and apertures 52' of the other half 48 as depicted in FIG. 3. By providing a force fit between the protuberances 50 and apertures 52, the bushing halves 46, 48 may be held in place relative to each other. In the embodiment of FIGS. 1 to 8, the insulative bushing 22 is generally cylindrical, having a stepped outer portion 56 between ends 38 and 40. In the embodiment of FIGS. 1 to 8, each bushing half 46, 48 comprises base 54 having several semi-circular recesses extending into such base. For example, a semi-circular recess 58 extends into base 54 at end 38 and a semi-circular recess 60 extends into base 54 at end 40. Similarly, a semi-circular abutment recess 62 extends into base 54 at a position between recesses 58 and 60. The abutment region 44' protrudes away from bore surface 44 of the recess 62 towards axis 36, and includes a first surface 64, having a channel 66 therein, and an adjacent second surface 68, having a channel 70 therein. In this manner, surfaces 64 and 68 form an abutment region 44' which comprises a protuberance which extends in a radial direction, relative to axis 36 from bore surface 44 towards axis 36. A semi-circular recess 72 is provided which extends into base 54 between recess 58 and abutment recess 62. When assembled, a base 54 of bushing half 46 will be contiguous with a similar base 54' of bushing half 48 as depicted in FIG. 3 such that each semi-circular recess in bushing half 46 will be radially aligned with a respective similar semi-circular recess in bushing half 48 to form a respective length of bore 42, and the abutment region 44' will be positioned in the length of the bore 42 formed by the aligned semi-circular abutment recesses 62.

In the present invention, a contact is provided which extends into the insulative bushing bore, the contact comprising at least one contact abutment region, at an outer surface of the contact, which is positioned in the connector assembly adjacent an abutment region of the insulative bushing to prevent turning of the contact around the longitudinal axis of the contact. For example, in the embodiment of FIGS. 1 and 2, a contact 24 is provided which extends into bore 42 from end 38 towards end 40. Contact 24 comprises two contact abutment regions which are provided on opposite sides of the contact. In particular, with reference to FIGS. 1, 2, 9 and 10, contact 24 comprises two contact regions formed by recesses 74, 76 which extend into an outer surface 78 on opposite sides of the contact. Recesses 74, 76 each extend into the outer surface 78 in a radial direction relative to longitudinal axis 36. In the connector assembly of FIGS. 1 and 2, each contact abutment region 74, 76 is positioned adjacent a bushing abutment region 44' to prevent turning of the contact 24 around a longitudinal axis 80 of the contact, axis 80 being coincident with axis 36.

In the abutment of FIGS. 1, 2, 9 and 10, the contact 24 comprises a flange 82 which extends from outer surface 78. Flange 82 is positioned between the abutment region formed by recesses 74, 76 and an end 84 of the contact 24 which extends out of the bore 42. As depicted in FIG. 1, a segment 86 of contact 24 extends into the length of the bore 42 formed by the semi-circular recesses 58. In addition, the flange 82 extends into the length of the bore 42 formed by the semi-circular recesses 72 and thereby prevents axial movement of the contact relative to the bushing. Each abutment region 74, 76 extends into the length of the bore 42 formed by the semi-circular abutment recesses 62.

The coaxial cable 30 comprises a length 88 of the cable central conductor which extends from an end 90 of the cable into the bore 42 from end 40 towards end 38. The length 88 is electrically and mechanically connected to the contact 24 as, for example, by soldering. In the embodiment of FIG. 1, the end 90 of the coaxial cable 30 comprises a length 92 of insulative material from which the length 88 of the central conductor extends. The length 92 of insulative material extends into the length of the bore 42 formed by the semi-circular recesses 60. In the embodiment of FIGS. 1 and 2, the length 88 of central conductor extends into a recess 76 and is soldered to the contact.

If desired, the end 40 of the insulative bushing 22 may be provided with one or more protuberances 94 which extend from the surface 44 of bore 42 towards longitudinal axis 36. As depicted in FIG. 1, such protuberances 94 are provided to bear against the outer surface of the length 92 of coaxial cable 30 when the bushing halves 46, 48 are connected together as described herein by inserting protuberances 50 into respective apertures 52.

The connector assembly of FIG. 1 includes a conventional conductive connector shell 26 which extends in longitudinal direction 34. The insulative bushing 22 is positioned in the connector shell 26 by inserting the insulative bushing in the end 96 of the connector shell. A shield layer 98 folded back upon the coaxial cable 30 in the conventional manner engages an inner surface 100 of the connector shell 26 to provide the desired grounding.

In assembling the connector assembly 28 of FIG. 1, a kit may be provided which comprises the connector 20, including the insulative bushing 22, contact 24 and conductive connector shell 26. In such method of assembly, one end of the coaxial cable 30 is stripped in the usual manner to expose the length 92 of insulative material and the length 88 of central conductor, and the shield layer 98 is folded back upon the coaxial cable, in the conventional manner. Then the length 88 of the central conductor is positioned in one of the contact abutment recesses such as recess 76, which in the preferred embodiment extends in longitudinal direction 34 to provide an elongated recess. The length 88 is then soldered in place in recess 76.

The bushing halves 46, 68 are then positioned about the solder connection at recess 76 such that the length 92 of the coaxial cable 30 and the contact 24 inter fit with respective recesses of the bushing halves 46, 48 as described herein. The bushing halves 46, 48 are then connected together using respective protuberances 50 and apertures 52 as described herein. Finally, the assembled connector 20 and coaxial cable 30 are inserted into end 96 of the conductive connector shell 26 and may be held in place by providing a force fit between the outer surface 102 of the bushing 22 and the inner surface 100 of the connector shell 26.

Figure 11:
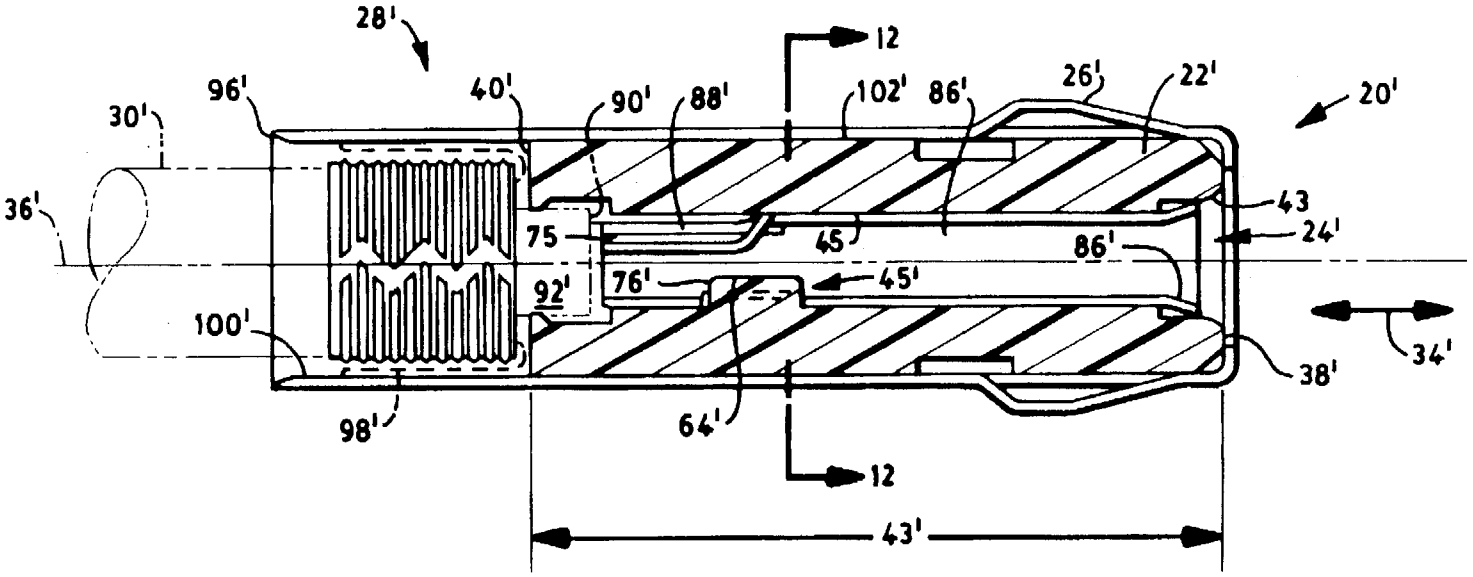
FIG. 11 is a view of kit parts of an alternative embodiment of the present invention assembled with a coaxial cable to provide an alternative connector assembly embodying the present invention.
Figure 12:
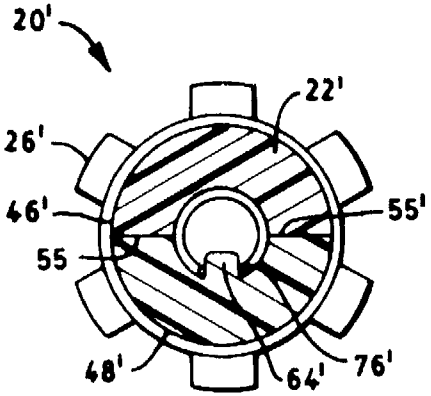
FIG. 12 is a view of FIG. 11 taken along lines 12—12.

In an alternative embodiment depicted in FIGS. 11 and 12, a connector assembly 28' is provided which comprises a connector 20' and a coaxial cable 30'. The connector 20' comprises an insulative bushing 22', a contact 24', and a conductive connector shell 26'. In this embodiment, the contact 24' is a female contact in the form of a metal ferrule.

Figure 13:
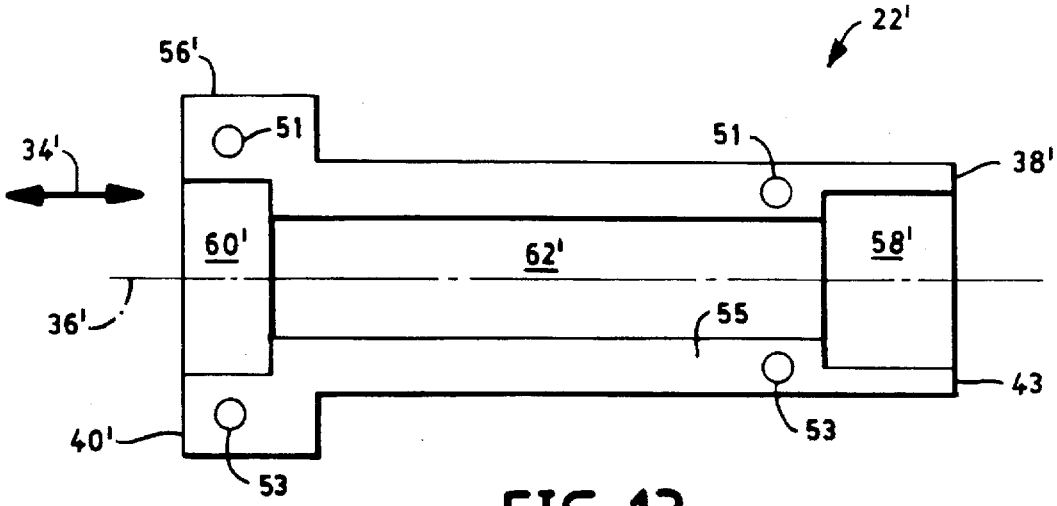
FIG. 13 is a plan view of one insulative bushing half of the embodiment of FIG. 11.
Figure 14:
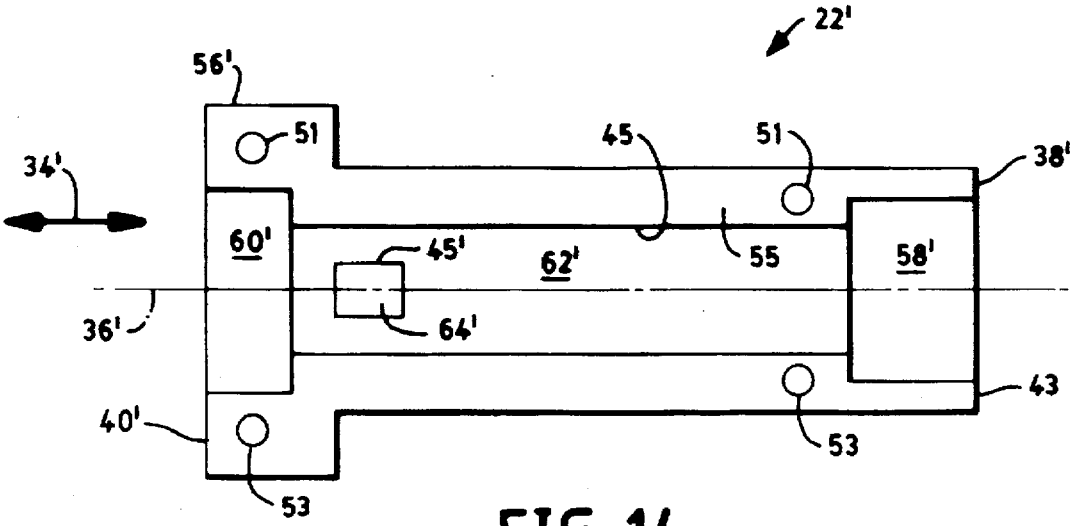
FIG. 14 is a plan view of the other insulative bushing half of the embodiment of FIG. 11.
Figure 15:
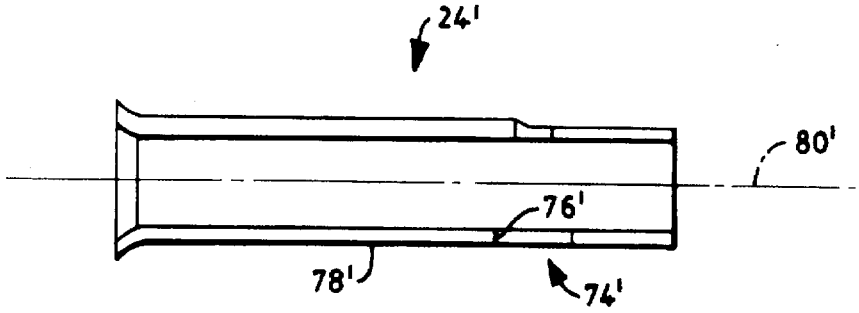
FIG. 15 is aside view of the contact of the embodiment of FIG. 11.
Figure 16:
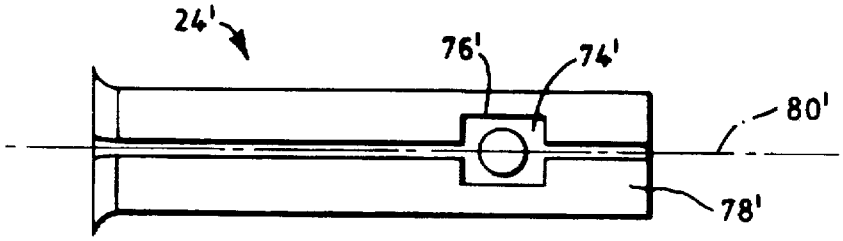
FIG. 16 is a bottom view of the contact of FIG. 15.
Figure 17:
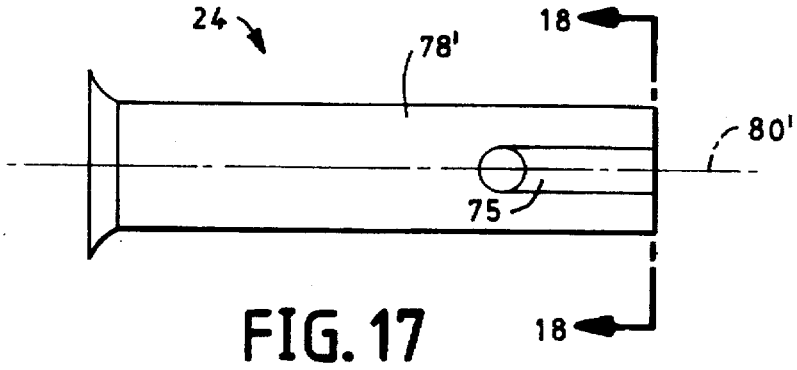
FIG. 17 is a top view of the contact of FIG. 15.
Figure 18:
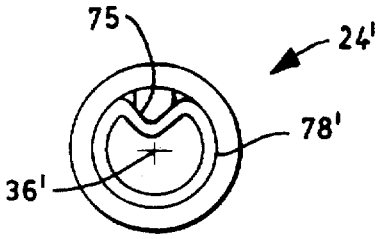
FIG. 18 is a view of FIG. 17 taken along lines 18—18.

FIGS. 13 and 14 depict details of the insulative bushing 22' of FIGS. 11 and 12. Insulative bushing 22' extends in a longitudinal direction 34' relative to a longitudinal axis 36' of the insulative bushing from an end 38' to an opposite end 40'. The insulative bushing 22' comprises a bore 43, having a bore length 40', which extends in the longitudinal direction 34' from end 38' to end 40'. The bore 43 includes a bore surface 45 which comprises at least one abutment region. In the embodiment of FIGS. 11 and 12, one abutment region 45' is provided.

In the preferred embodiment, the insulative bushing comprises two separable mating halves. For example, in the embodiment of FIGS. 11 and 12, the insulative bushing 22' comprises two halves 46'48' which are identical except as noted herein. Halves 46', 48' are joined together by providing a plurality of protuberances 51 and apertures 53 which extend from and into, respectively, a base surface 55 of each bushing half. The halves 46', 48' may be joined by mating the protuberances 51 and apertures 53 of one half 46' with similar protuberances 51 and apertures 53 of the other half 48' in a manner similar to the embodiment of FIG. 1 as depicted at FIG. 3. By providing a force fit between the protuberances 51 and apertures 53 the bushing halves 46', 48' may be held in place relative to each other. In the embodiment of FIGS. 13 and 14, the insulative bushing 22' is generally cylindrical, having a flanged outer portion 56' at end 40'. In the embodiment of FIGS. 13 and 14, each bushing half 46', 48' comprises base 55 and several semi-circular recesses extending into such base. For example, a semi-circular recess 58' extends into base 55 at end 38' and a semi-circular recess 60' extends into base 55 at end 40'. Similarly, a semi-circular abutment recess 62' extends into base 55 at a position between recesses 58' and 60'. The abutment region 45' protrudes away from bore surface 45 of the recess 62 towards axis 36' and includes a protuberance 64'. In this manner, protuberance 64' forms an abutment region 45' which comprises a protuberance which extends in a radial direction, relative to axis 36', from bore surface 45 toward axis 36'. When assembled, a base 55 of bushing half 46' will be contiguous with a similar base 55' of bushing half 48' as depicted in FIG. 12 such that each recess in bushing half 46' will be radially aligned with a respective similar recess in bushing half 48' to form a respective length of bore 43, and the abutment region 45' will be positioned in the length of the bore formed by the aligned abutment recesses 62'.

In the embodiment of FIGS. 11 and 12, a female contact 24' is provided which extends into the insulative bushing bore, the contact comprising at least one contact abutment region, at an outer surface of the contact, which is positioned in the connector assembly adjacent an abutment region of the insulative bushing, to prevent turning of the contact around the longitudinal axis of the contact. The details of contact 24' are depicted in FIGS. 15 to 18. The contact 24' comprises a conductive ferrule having an aperture 74' being surrounded by an aperture wall 76', the aperture 74' extending through a side 78' of the contact. The abutment region of contact 24' comprises wall 76'. As depicted in FIGS. 11 and 12, the protuberance 64', which forms abutment region 45', extends into the aperture 74' such that the engagement of the protuberance with the aperture wall 76' prevents turning of the contact 24' around a longitudinal axis 80' of the contact, axis 80' being coincident with axis 36'. Such engagement also prevents movement of the ferrule relative to bushing 22' in the direction 34'.

As depicted in FIG. 11, a fluted segment 86' of contact 24', extends into the length of the bore 43 formed by the semi-circular recesses 58'. The abutment region of contact 24' formed by wall 76' extends into the length of the bore 43 formed by the abutment recesses 62'.

The coaxial cable 30' comprises a length 88' of the cable central conductor which extends from an end 90' of the cable into the bore 43 from end 40' towards end 38'. The length 88' is electrically and mechanically connected to the contact 24' as, for example, by soldering. In the embodiment of FIG. 11, the end 90' of the coaxial cable 30' comprises a length 92' of insulative material from which the length 88' of the central conductor extends. The length 92' of insulative material extends into the length of the bore 43 formed by the semi-circular recesses 60'. In the embodiment of FIG. 11, the ferrule comprises a ferrule recess 75, best depicted in FIGS. 17 and 18, which extends into the side 78' of the ferrule in a radial direction relative to the longitudinal axis 36'. The ferrule recess 75 extends in longitudinal direction 34, and the length 88' of the central conductor extends in the ferrule recess, the length 88' being soldered to the contact.

If desired, the end 40' of the insulative bushing 22' may be provided with one or more protuberances similar to protuberances 94 of FIGS. 1 to 8. Further, the connector assembly of FIGS. 11 and 12 includes a conventional conductive connector shell 26' which extends in longitudinal direction 34'. The insulative bushing 22' is positioned in the connector shell 26' by inserting the insulative bushing in the end 96' of the connector shell. A shield layer 98' folded back upon the coaxial cable 30' in the conventional manner engages an inner surface 100' of the connector shell 26' to provide the desired grounding.

In assembling the connector assembly 28' of FIG. 1, a kit may be provided which comprises the components of the connector 20', including the insulative bushing 22', contact 24' and conductive connector shell 26'. In the method of assembly, one end of the coaxial cable 30' is stripped in the usual manner to expose the length 92' of insulative material and the length 88' of central conductor, and the shield layer 98' is folded back upon the coaxial cable, in the conventional manner. Then the length 88' of the central conductor is positioned in the contact abutment recess such as recess 75, which in the preferred embodiment extends in longitudinal direction 34' to provide an elongated recess, and the length 88' is soldered in place in recess 75. The bushing halves 46', 48' are then positioned about the solder connection at recess 75 such that the length 88' of the coaxial cable 30' and the contact 24' inter fit with respective recesses of the bushing halves 46', 48' as described herein. The bushing halves 46', 48' are then connected together using respective protuberances 51 and apertures 53 as described herein. Finally, the assembled connector 20' and coaxial cable 30' are inserted into end 96' of the conductive connector shell 26' and may be held in place by providing a force fit between the outer surface 102' of the bushing 22' and the inner surface 100' of the connector shell 26'.

Fabrication of the various components described herein may be accomplished using conventional procedures. For example, the insulative bushing may be molded from a plastic material. The conductive members including male and female contacts and connector shell may be stamped from a metal sheet and then rolled and/or bent if required to form the desired configuration.

The embodiments which have been described herein are but some of several which utilize this invention and are set forth here by way of illustration but not of limitation. It is apparent that many other embodiments which will be readily apparent to those skilled in the art may be made without departing materially from the spirit and scope of this invention as defined by the appended claims.

What is claimed is:

1. A connector assembly, comprising:

an insulative bushing, said bushing comprising a first bushing half and a separable second bushing half and extending in a longitudinal direction relative to a longitudinal axis of said insulative bushing from a first bushing end to a second bushing end, said insulative bushing comprising a bore extending in said longitudinal direction from said first bushing end to said second bushing end, said bore comprising a bore surface, said bore surface comprising at least one first abutment region, each of said bushing halves comprising a base, a first semi-circular recess extending into said base at said first bushing end, a second semi-circular recess extending into said base at said second bushing end, and a semi-circular abutment recess extending into said base at a position between said first semi-circular recess and said second semi-circular recess, a base of said first bushing half being contiguous with a base of said second bushing half, each recess of said first bushing half being aligned with a similar recess of said second bushing half to form a respective length of said bore, said at least one first abutment region being positioned in said respective length of said bore formed by aligned semi-circular abutment recesses, each of said bushing halves further comprising a third semi-circular recess extending into said base between said first semi-circular recess and said semi-circular abutment recess, said third semi-circular recess of said first bushing half being aligned with said third semi-circular recess of said second bushing half to form a respective length of said bore;

a contact extending into said bore from said first bushing end towards said second bushing end, said contact comprising at least one second abutment region positioned at an outer surface of said contact, said at least one second abutment region being positioned adjacent said at least one first abutment region to prevent turning of said contact around a longitudinal axis of said contact, said contact comprising a flange extending from said outer surface of said contact, said flange being positioned between said at least one second abutment region and an end of said contact extending out of said bore, a segment of said contact extending into said respective length of said bore formed by aligned first semi-circular recesses, said flange extending into length of said bore formed by aligned third semi-circular recesses, and said at least one second abutment region extending into said respective length of said bore formed by aligned abutment recesses;

a coaxial cable having a length of central conductor extending from an end of said coaxial cable, said length of central conductor extending into said bore from said second bushing end towards said first bushing end being electrically and mechanically connected to said contact; and a conductive connector shell extending in said longitudinal direction, said insulative bushing extending into said conductive connector shell.

2. The connector assembly of claim 1 wherein said end of said coaxial cable comprises a length of insulative material, said length of central conductor extending from said length of insulative material, said length of insulative material extending into said respective length of said bore formed by aligned second semi-circular recesses.

3. The connector assembly of claim 1 wherein said at least one first abutment region comprises a protuberance which extends in a radial direction, relative to said longitudinal axis, from said bore surface towards said longitudinal axis.

4. The connector assembly of claim 1 wherein said at least one first abutment region comprises a protuberance which extends in a radial direction, relative to said longitudinal axis, from said bore surface towards said longitudinal axis.

5. The connector assembly of claim 1 wherein said at least one second abutment region comprises a contact recess extending into said outer surface of said contact in a radial direction relative to said longitudinal axis, and further wherein said length of central conductor extends into a contact recess.

6. The connector assembly of claim 1 wherein said contact comprises a conductive ferrule, and further wherein said conductive ferrule includes an aperture extending through a side of said ferrule, said aperture being surrounded by an aperture wall, said at least one second abutment region comprising said aperture wall, said at least one first abutment region extending into said aperture.

7. The connector assembly of claim 6 wherein said ferrule comprises a ferrule recess extending into a side of said ferrule in a radial direction relative to said longitudinal axis, said ferrule recess extending in said longitudinal direction, and further wherein said length of central conductor extends into said ferrule recess.

8. The connector assembly of claim 1 wherein said first bushing half comprises a plurality of protuberances and apertures which extend from and into, respectively, said base of said first bushing half, and wherein said second bushing half comprises a plurality of mating apertures and protuberances which extend into and from, respectively, said base of said second bushing half.

9. A kit for securing a connector to an end of a coaxial cable having a central conductor extending from said end, comprising:

a first bushing half adapted to be mated with a second bushing half to form an insulative bushing, each of said first bushing half and said second bushing half comprising a base, a first semi-circular recess extending into said base at said first bushing end, a second semi-circular recess extending into said base at said second bushing end, and a semi-circular abutment recess extending into said base at a position between said first semi-circular recess and said second semi-circular recess, a base of said first bushing half being adapted to be positioned contiguous with a base of said second bushing half, so that each recess of said first bushing half will be aligned with a similar recess of said second bushing half to form a respective length of said bore, and said at least one first abutment region will be positioned in said respective length of said bore formed by aligned semi-circular abutment recesses, said insulative bushing extending in a longitudinal direction relative to a longitudinal axis of said insulative bushing from a first bushing end to a second bushing end, said insulative bushing comprising a bore extending in said longitudinal direction from said first bushing end to said second bushing end, said bore comprising a bore surface, said bore surface comprising at least one first abutment region, said bore being adapted to receive therein a central conductor of a coaxial cable at said second bushing end such that said central conductor may be extended into said bore from said second bushing end and positioned in a first abutment region;

a contact adapted to be inserted into said bore from said first bushing end towards said second bushing end, said contact comprising at least one second abutment region positioned at an outer surface of said contact, said at least one second abutment region adapted to be positioned adjacent said at least one first abutment region to prevent turning of said contact around a longitudinal axis of said contact; said first bushing half and said second bushing half each comprising a third semi-circular recess extending into said base between said first semi-circular recess and said semi-circular abutment recess, said third semi-circular recess of said first bushing half being adapted to be aligned with said third semi-circular recess of said second bushing half to form a respective length of said bore, and further wherein said contact comprises a flange extending from said outer surface of said contact, said flange being positioned between said at least one second abutment region and an end of said contact extending out of said bore when said contact is inserted into said bore, a segment of said contact being adapted to extend into said respective length of said bore formed by aligned first semi-circular recesses, said flange being adapted to extend into a length of said bore formed by aligned third semi-circular recesses, and said at least one second abutment regions being adapted to extend into said respective length of said bore formed by aligned abutment recesses and a conductive connector shell adapted to receive said insulative bushing therein.

10. The connector assembly of claim 9 wherein said insulative bushing is adapted to receive an end of said coaxial cable which comprises a length of insulative material, from which said length of central conductor extends, said insulative bushing being adapted so that said length of insulative material may be extended into said respective length of said bore formed by aligned second semi-circular recesses.

11. The connector assembly of claim 9 wherein said at least one first abutment region comprises a protuberance which extends in a radial direction, relative to said longitudinal axis, from said bore surface towards said longitudinal axis.

12. The connector assembly of claim 9 wherein said at least one second abutment region comprises a contact recess extending into said outer surface of said contact in a radial direction relative to said longitudinal axis, said contact recess being adapted to receive said length of central conductor.

13. The connector assembly of claim 9 wherein said contact comprises a conductive ferrule, and further wherein said conductive ferrule includes an aperture extending through a side of said ferrule, said aperture being surrounded by an aperture wall, said at least one second abutment region comprising said aperture wall, said at least one first abutment region being adapted to extend into said aperture.

14. The connector assembly of claim 13 wherein said ferrule comprises a ferrule recess extending into a side of said ferrule in a radial direction relative to said longitudinal axis, said ferrule recess extending in said longitudinal direction, said ferrule recess being adapted to receive said length of central conductor.

* * * * *